US005314195A

United States Patent [19]

Schulze

[11] Patent Number: 5,314,195

[45] Date of Patent: May 24, 1994

[54] DART GAME

[75] Inventor: Ulrich Schulze, Wiesbaden, Fed. Rep. of Germany

[73] Assignee: NSM Aktiengesellschaft, Bingen, Fed. Rep. of Germany

[21] Appl. No.: 915,821

[22] PCT Filed: Jan. 9, 1991

[86] PCT No.: PCT/DE91/00053

§ 371 Date: Jul. 27, 1992

§ 102(e) Date: Jul. 27, 1992

[87] PCT Pub. No.: WO91/11674

PCT Pub. Date: Aug. 8, 1991

[30] Foreign Application Priority Data

Jan. 25, 1990 [DE] Fed. Rep. of Germany ..... 4002126

[51] Int. Cl.[5] ..... F41J 3/00

[52] U.S. Cl. ..... 273/371; 273/372

[58] Field of Search ..... 273/376, 371, 372, 373, 273/374, 375, 377, 408

[56] References Cited

U.S. PATENT DOCUMENTS

| | | | |
|---|---|---|---|
| 2,168,644 | 8/1979 | Browning . | |
| 3,836,148 | 9/1974 | Manning | 273/371 |
| 4,057,251 | 11/1977 | Jones et al. | 273/376 |
| 4,333,657 | 8/1982 | Jaworski | 273/376 |
| 4,516,781 | 5/1985 | DeVale et al. . | |
| 4,586,716 | 5/1986 | Brejcha | 273/376 |
| 4,635,940 | 1/1987 | Kelley . | |
| 4,768,789 | 9/1988 | Clark . | |
| 4,804,193 | 2/1989 | Lin et al. | 273/376 |
| 4,840,383 | 6/1989 | Lombardo | 273/376 |

FOREIGN PATENT DOCUMENTS

| | | |
|---|---|---|
| 0082715 | 6/1983 | European Pat. Off. . |
| 3341303 | 6/1984 | Fed. Rep. of Germany . |
| 8803638 | 5/1988 | PCT Int'l Appl. . |
| 282422 | 8/1952 | Switzerland . |
| 2030877 | 4/1980 | United Kingdom . |

OTHER PUBLICATIONS

"The Way to Play", Diagram Group, p. 139 Mar. 15, 1976.

*Primary Examiner*—Mark S. Graham

*Attorney, Agent, or Firm*—Spencer, Frank & Schneider

[57] ABSTRACT

A dart game includes a target board (22) with segments which are movably mounted between radial ribs (24) and concentric ribs (26) to receive the darts. Each segment has a switch which is actuated when a dart hits the segment and which is connected to a hit-display. The target board has at least two target fields (50 to 56), each of which is made up of segments located between adjacent radial ribs (24). A display light (60 to 66) is associated with each segment of a target field. All the lights of each target field are switched on only by hits on this target field by the first player to hit it, and the display lights of the target field concerned are not switched on by or after a subsequent hit by another player. The display lights (60, 62, 64, 66) may be disposed in more or more arrays (42, 44, 46, 48), making the progress of the game particularly easy to follow.

9 Claims, 2 Drawing Sheets

DART GAME

BACKGROUND OF THE INVENTION

The invention relates to a dart game for several players, the game comprising a dart board composed of segments that are movably arranged between radial and concentric ribs so as to receive the thrown darts, each segment having an associated switch that is actuated by the impact of a dart and is connected by way of a switching device with a hit display.

Dart games are known in various embodiments. The darts are always thrown at a dart board that is divided into a number of segments. Each segment is provided with a switch which is actuated when a dart hits it. With every hit on a segment, a certain number of points is scored. The playing and scoring rules are different and frequently relatively complicated.

German Unexamined Published Patent Application DE-OS 3,341,303 discloses a dart game of the above-mentioned type in which the recording, counting and display of the points scored by each player is performed automatically. For this purpose, the dart board has an associated switching matrix that is connected with a microcomputer. A display is also provided which includes display fields for indicating the scores of the various players and the number of points scored at the moment.

The dart game disclosed in Unexamined Published Patent Application WO-OS 88/03638 includes a display for the progression and status of a game. The display provides information about the number of coins fed in and the available games and leads the player through the selection of a game and the number of players.

SUMMARY OF THE INVENTION

It is the object of the invention to make the playing of the game in a dart game device of the above-mentioned type more interesting, attractive and suspenseful and thus offer more entertainment and make playing the game more enticing to the players.

A dart game according to the invention includes at least two target fields which are each formed of segments that are arranged between adjacent radial and concentric ribs, with each segment of the target fields having an associated display lamp. All of the display lamps of each target field can be actuated only by a hit from the player who is the first to hit this target field. The display lamps of the respective target field can no longer be actuated upon and after a hit by another player.

In the dart game according to the invention a target field thus includes segments which are defined by ribs and which are able to actuate a switch when hit by a dart. The segments of a target field are here each to be hit by one player, with the associated switch in each case being actuated and the hit display lighting up accordingly. If, however, it is another player's turn and this player hits a segment of a target field in which some segments have already been hit by the one player, the one player loses the opportunity to hit all segments of the target field and he thus loses this target field and the corresponding points won.

According to the object of the game, it is thus not only the hitting of segments that is important but also the throwing skill and tactics during selection of the segments at which to aim. On the one hand, it is important to fill a target field by hitting its segments, and on the other hand,, hitting one of the segments at which the opponent is aiming will prevent the opponent from filling this target field. Successful hitting of expedient segment combinations leads to a high number of points and to a reduction of the opponent's points. The competitive attraction in this game is high due to the many variations in the progression of the game and the game is played quickly.

The observation of the progression of the game is made possible by the display lamps which each light up as soon as a segment of a player's target field is hit. Thus it is possible to see the segment combinations that are being developed.

In an advantageous embodiment of the dart game according to the invention, the game ends with a win when all display lamps of a target field are lit up. In this case, one or several target fields are provided, preferably between adjacent radial and/or concentric ribs.

Although generally each segment has its associated display lamp which lights up if a dart hits the segment in question, a display lamp may also be associated with two or three segments in such a way that it lights up if one of these segments is hit. In addition, an acoustical signal may of course also be provided as a hit indication.

Certain hit/segment combinations may be provided according to preferred figures (column, row, etc.) as preferred combinations in which case a player attempts to prevent the opponent from building up a hit/segment combination, similarly as this is the case in a game of morris. By arranging the display lamps in one or several matrix fields, it is easy to read out which segments are still free of hits and to select accordingly the segments that are most favorable as a target for further playing. If an intended segment is hit, the respective display lamp lights up. Otherwise, the throw is considered a miss and no display lamp lights up.

In an advantageous embodiment of the dart game according to the invention which includes a counter that responds to switch actuations, a multiplier is connected with the counter so as to be actuated at a given combination of switch actuations. If a certain combination of segments is hit on the dart board, the multiplier is initiated and switched in so that the combination points are included in the point count with a coefficient.

Preferably, each player has his own matrix field display. In a preferred dart game according to the invention this is realized by a switching device and a memory device connected therewith for the switching state of the display lamps disposed in the matrix fields. Actuation of the switching device switches the display lamps according to the stored switching state and at the same time, the previously displayed switching state is stored. Automatic or manual act--nation of the switching device causes the matrix field and the display lamps to indicate the momentary state of the presently active player's game. In this connection it may be provided that segments already hit by other players are additionally indicated in a special manner as being occupied, for example, in that the respective display lamps light up, with the display lamps of the segments just hit by the player being in a blinking state.

For the case of several players, the switching device advisably has several sets of associated matrix field memory data and the switching device includes a selector switch with which the display of a set of switching states is selected from the stored matrix field memory data. In this case, the presently applicable matrix field is displayed, that is, the matrix field of the presently playing player, while the remaining matrix fields are stored and are thus virtual matrix fields.

It may also be provided that there are several matrix fields corresponding to the intended number of players and a selector switch is provided,,with which the switching state of the switches is selected according to one of the switching states displayed in the matrix fields and with which the lamps are switched accordingly. In that case, all matrix fields associated with the players are displayed and only the matrix field of the presently active player is activated by actuation of the switch. A hit on the dart board then causes a change in the display of the respective active matrix field in that the respective display lamp begins to blink while the already hit segments in the other matrix fields are indicated by the associated display lamps lighting up. Preferably three or four matrix fields are provided. This number corresponds to the optimum number of players.

In another preferred embodiment of the dart game according to the invention, the display lamps associated with the switches are distributed around the dart board. This arrangement makes a more direct reference between the matrix fields and their partial regions relative to the segments of the dart board. The players thus see very easily and at just one glance which one of the segments has already been hit or not. In this arrangement the partial regions of the matrix field are distributed to correspond to the segment arrangements. If, for example, the dart board is divided into concentric rings that are sub-divided radially, the partial regions of the matrix field may be arranged, for example, in the form of a row that extends radially toward the center of the dart board and outside of the associated sector. A display lamp in such a row, for example a light-emitting diode, corresponds in each case to one concentric section.

BRIEF DESCRIPTION OF THE DRAWINGS

Insofar as the same components are shown in the two embodiments of FIGS. 1 and 2, these are given the same reference numerals. However, the illustrations should not be considered to be limiting.

DESCRIPTION OF THE PREFERRED EMBODIMENTS

Figure 1:
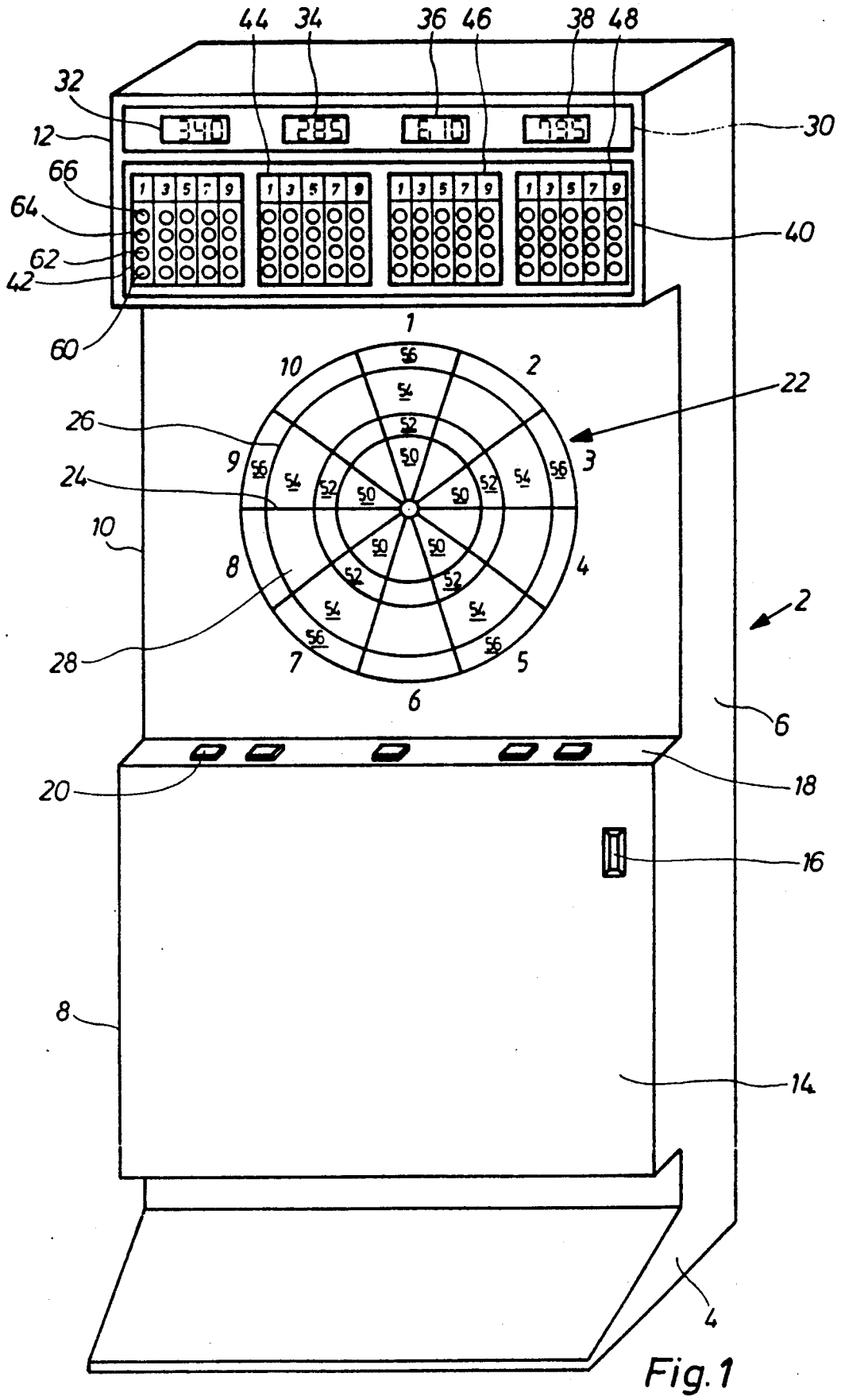
FIG. 1 is a perspective view of a first embodiment of the dart game according to the invention.

Initially, a first embodiment of the invention will be described with reference to FIG. 1. The dart game includes a housing 2 having a base section 4 and side walls 6. Somewhat above base section 4, housing 2 has a projecting section 8. Above this, a set-back section 10 is arranged. Above the set-back section 10 there is again a projecting section 12 as the uppermost housing section.

On a front plate 14, the projecting section 8 is provided with a slot 16 for the insertion of coins. Keys 20 are provided as operating elements on a cover plate 18 on the projecting section 8. The desired game operation, the number of players, a change of players, etc. can be selected by means of these keys. Advisably, keys 20 are simultaneously configured as display elements so that the selections put in are indicated.

The set-back section 10 is equipped with a dart board 22. By means of radial ribs 24 and concentric ribs 26, dart board 22 is divided into a number of segments 28 which are mounted so as to be movable in a direction perpendicular to the segment surface. Ribs 24 and 26 are given an arrowhead configuration at their outer sides in order to deflect incoming darts to adjacent segment 28. In the illustrated embodiment, segments 28 are each provided with a number of non-illustrated openings into which the tips of impinging darts are able to penetrate. Behind the segments there are switches that are actuated by a displacement movement of the segments as a result of the impact of a dart. In the illustrated embodiment, dart board 22 is divided into ten sectors which are numbered 1 to 10. The numbering is applied radially outside of each sector.

In an upper display region 30, the upper projecting section 12 includes four numerical displays 32 to 38 which may be, for example, LED [light-emitting diode] displays. On a lower display region 40, four display fields 42 to 48 are provided. Each display field 42 to 48 has five columns which are marked in the upper row of the display fields with the numerals 1, 3, 5, 7 and 9. The columns each include four luminous displays that are lit by display lamps, for example light-emitting diodes. The numerals 1, 3, 5, 7 and 9 each identify a sector of the dart board associated with the column on which valid hits can be made. The sectors marked 2, 4, 6, 8 and 10 are thus non-selectable fields. Hits landing on these fields do not count.

In the illustrated embodiment, a display lamp is associated with each segment 28 of each odd-numbered sector. This means, for example in the case of sector 1, the innermost segment 50 of sector 1 is coupled with the lowermost display lamp 60 of the left column of display field 42. The two middle display lamps 62 and 64 are associated with the two middle segments 52 and 54. The uppermost display lamp 66 indicates the hit status of the uppermost or outermost segment 56.

In the illustrated embodiment, four display fields for four players are provided by display fields 42 to 48. By actuating the appropriate key 20, the corresponding display field 42, 44, 46 or 48 is activated to indicate the hit level of the respective active player while the remaining display fields each indicate the hit level of a waiting player.

By arranging the display lamps in matrix fields, the person specific state of the game and the number of hits scored as a whole is given in a very clear form. It can be determined at a glance which one of the segments of the dart board has already been hit and which player has hit which segments. The points resulting from the hits in each case and the total number of points are displayed in numerical displays 32 to 38. For example, the player associated with the left numerical display 32 and the left display field 42 has realized a total number of 340 points.

The configuration of the luminous display as a matrix field also permits a variation of play in which certain segment combinations are connected with higher numbers of points. For example, sequences of adjacent display lamps, for example three adjacent display lamps in a row or three adjacent display lamps in a column, may be considered preferred hit combinations and may lead to a higher coefficient. If such a sequence is realized, a multiplier may be switched in by an internally provided evaluation device so that the points for the sequence are multiplied, for example, by the number 3. Other formations may also be selected.

The end of the game may be set at the point in time at which all segments have been hit, that is, when all display lamps of a matrix field are lit. The respective player is then the winner. Another variation of the dart game may be configured in such a way that the winner is whoever first scores a certain number of points. The game thus provides a competitive attraction for the players. The winner of the dart game is always the person who is a skilled thrower and also a tactician because, on the one hand, it is important to score as many points as possible for oneself and, on the other hand, by selecting the segments to be hit in a specific way, to prevent the opponent from scoring possible points.

Figure 2:
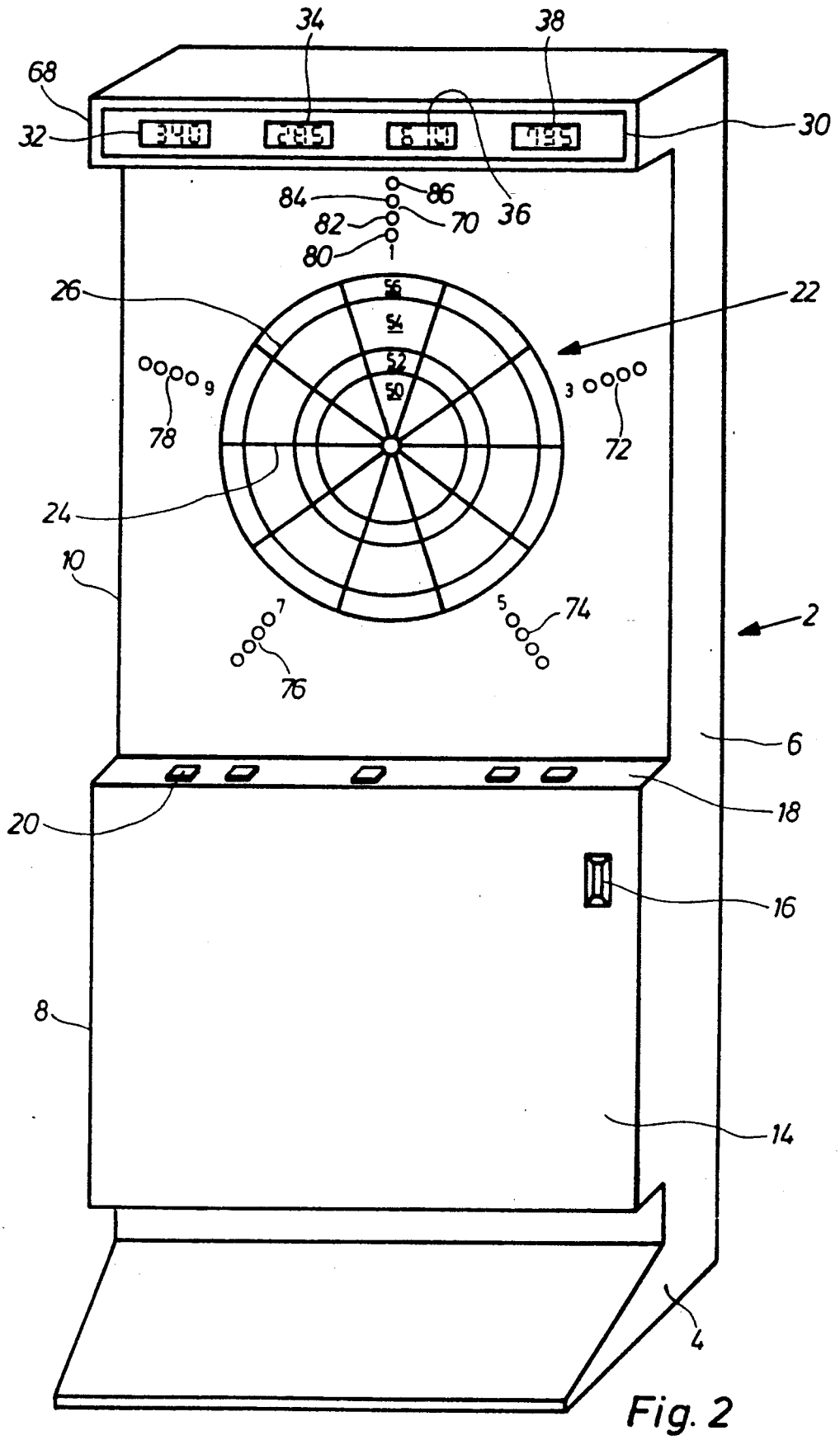
FIG. 2 is a perspective view of a second embodiment of the dart game according to the invention.

FIG. 2 shows a variation of the dart game according to the invention. Housing 2 has a narrower upper, projecting section 68 which has only a single display region 30 with numerical displays 32 to 38. Instead of display fields 42 to 48 as in the first embodiment, the dart game shown in FIG. 2 is provided with radial display columns 70 to 78 which each include four display lamps or light-emitting diodes, respectively. The display lamps of each radial display column 70 to 78 are each associated with the segments of one of sectors 1, 3, 5, 7 and 9. For example, the inner display lamp 80 of radial display column 70 indicates that the inner segment 50 of sector 1 was hit. Correspondingly, the middle display lamps 82 and 84 are associated with middle segments 52 and 54, respectively, and the outer display lamp 86 is associated with the outer segment 56 of sector 1. In this embodiment of the dart game, only the total number of segments hit and the points scored by the respective players are indicated. Thus a variation of the game can be played on only a single playing field, a game that is quite similar to a game of morris, while the dart game of FIG. 1 with its virtual matrix fields includes an active playing field and several virtual playing fields.

Of course diverse variations and modifications are possible. The features of the dart game according to the invention as disclosed in the claims, the specification and the drawings may be employed, in particular, individually or also in any desired combination.

I claim:

1. A dart game for use by dart game players, comprising:

a dart board which includes a plurality of radial ribs, a plurality of concentric ribs, a plurality of target fields, each of the target fields including a plurality of segments which are disposed between the ribs to receive darts, and a plurality of switches, each switch corresponding to a respective segment and being activated when the respective segment is hit by a dart;

a hit display which includes a plurality of groups of display lamps, the groups of display lamps corresponding to the target fields so that each target field has at least one group corresponding to it, each of the display lamps in a group corresponding to a respective segment of the corresponding target field; and means, responsive to the switches and including a memory device, for selectively illuminating display lamps when the corresponding segments of the dart board are hit by darts, the display lamps being selectively illuminated in such a manner that a first one of the display lamps corresponding to a given target field is illuminated when a first one of the segments of the given target field is hit by a dart thrown by a player and thereafter further display lamps corresponding to the given target field are illuminated only when further segments of the given target field are hit by darts thrown by the same player.

2. A dart game according to claim 1, wherein the groups of display lamps are disposed in rows and columns which form at least one matrix field, wherein the display lamps have on/off states, wherein the memory device stores sets of matrix field memory data indicating on/off states of the display lamps, and wherein the means for selectively illuminating display lamps comprises means for illuminating display lamps of the at least one matrix field to display a stores set of matrix field memory data and for simultaneously storing a previously-displayed set of on/off states.

3. A dart game according to claim 1, wherein each target field has a plurality of groups of display lamps corresponding to it, and wherein the groups of display lamps are disposed in rows and columns which form a plurality of matrix fields, each matrix field having a display lamp for every segment of every target field.

4. A dart game according to claim 1, wherein each target field has a single group of display lamps corresponding to it, the group of display lamps corresponding to a given target field being disposed in a radially-extending row adjacent the given target field.

5. A dart game according to claim 1, wherein at least one of the target fields is composed of segments that are disposed between an adjacent pair of radial ribs.

6. A dart game according to claim 1, wherein at least one of the target fields is composed of segments that re disposed between an adjacent pair of concentric ribs.

7. A dart game according to claim 1, further including a counter that responds to switch actuations, and a multiplier that is connected with the counter so as to be actuated at a given combination of switch actuations.

8. A dart game according to claim 1, wherein the groups of display lamps are disposed in rows and columns which form at least one matrix field, wherein the memory device stores sets of matrix field memory data, and wherein the means for selectively illuminating display lamps further includes selector switch means for designating one of the sets of matrix field memory data to be displayed.

9. A dart game according to claim 1, wherein the groups of display lamps are distributed around the dart board.

* * * * *

UNITED STATES PATENT AND TRADEMARK OFFICE

CERTIFICATE OF CORRECTION

PATENT NO. : 5,314,195

DATED : May 24, 1994

INVENTOR(S) : Ulrich Schulze

It is certified that error appears in the above-indentified patent and that said Letters Patent is hereby corrected as shown below:

On the title page under [22], "Jan. 9, 1991" should be --Jan. 19, 1991--.

Signed and Sealed this

Twenty-third Day of August, 1994

Bruce Lehman

*Attest:*

BRUCE LEHMAN

*Attesting Officer*

*Commissioner of Patents and Trademarks*